US005501474A

United States Patent [19]

Conte

[11] Patent Number: 5,501,474

[45] Date of Patent: Mar. 26, 1996

[54] BRAKING DEVICE FOR IN-LINE SKATES

[75] Inventor: Gino Conte, Caerano San Marco, Italy

[73] Assignee: Roces S.R.L., Montebelluna, Italy

[21] Appl. No.: 333,712

[22] Filed: Nov. 3, 1994

[30] Foreign Application Priority Data

Apr. 12, 1994 [IT] Italy ..... MI94A0674

[51] Int. Cl.[6] ..... A63C 17/14

[52] U.S. Cl. ..... 280/11.2; 280/11.22

[58] Field of Search ..... 280/11.2, 11.22, 280/11.23, 11.28

[56] References Cited

U.S. PATENT DOCUMENTS

| | | | |
|---|---|---|---|
| 1,603,588 | 10/1926 | Eberle | 280/7.13 |
| 3,339,936 | 9/1967 | Hamlin | 280/11.2 |
| 5,067,736 | 11/1991 | Olson et al. | 280/11.2 |
| 5,088,748 | 2/1992 | Koselka et al. . | |
| 5,118,122 | 6/1992 | Ricart | 280/11.2 |
| 5,135,244 | 8/1992 | Allison | 280/11.22 |
| 5,192,099 | 3/1993 | Riutta | 280/11.22 |

FOREIGN PATENT DOCUMENTS

| | | | |
|---|---|---|---|
| 0379906 | 8/1990 | European Pat. Off. . | |
| 559179 | 9/1993 | European Pat. Off. | 280/11.22 |
| 0607817 | 7/1994 | European Pat. Off. . | |
| 62701 | 10/1948 | Netherlands | 280/11.2 |
| 9312846 | 7/1993 | WIPO | 280/11.22 |

*Primary Examiner*—Karin L. Tyson
*Attorney, Agent, or Firm*—R. Neil Sudol; Henry D. Coleman

[57] ABSTRACT

A braking device for in-line skates is constituted by a body (7) with which one of the wheels (6) is rotatably associated. The body is pivoted to the frame (2), so that it can oscillate in contrast with adjustable springs (18a, 18b) and is interposed between two mutually contiguous wheels and interacts, together with the frame, with the two wheels when the skate is rotated forwards or backwards.

19 Claims, 4 Drawing Sheets

BRAKING DEVICE FOR IN-LINE SKATES

BACKGROUND OF THE INVENTION

1. Field of the Invention

The present invention relates to a braking device for inline skates.

2. Description of the Prior Art

Stopping the skate during sports practice is currently a problem both for the ordinary user and for the athlete.

In conventional skates, a brake is in fact associated at the rear of the wheel supporting frame and is constituted by a pad, made of soft or semirigid plastic material, which is made to interact with the ground when the user tilts the skate backwards.

This operation however is dangerous and uneasy both for the amateurs and the athletes that may lose their balance. Furthermore, the pad wears considerably and must be replaced very often.

Solutions are also known that entail the interaction of a brake directly on the rolling surface of the wheel. The consequent drawback is that the braking action that is achieved is sudden, because it is concentrated on a single wheel and because a brisk actuation by the user is required when tilting the skate.

The aim of the present invention is therefore to solve the drawbacks described above by providing a skate that allows both an amateur user and an athlete to stop the skate, or reduce its speed gradually, and to perform this maneuver in safety.

Another object is to provide a skate with aligned wheels that allows better control over the braking action, customizing it according to the type of track being used and to the particular sport being practiced, such as slalom or speed skating.

Another important object is to provide a skate that has a simple structure and is easy to industrialize. Another object is to provide a skate that allows the user to maintain good balance while braking.

Another object is to provide a skate that is reliable, safe in use, and has very low manufacturing costs allowing its widespread diffusion.

SUMMARY OF THE INVENTION

This aim, these objects and others which will become apparent from the description that follows are achieved by a braking device for skates having at least two in-line wheels associated with a frame, characterized in that it comprises a body pivoted to said frame in a region between said two wheels, one of said wheels being associated with said body, said body being adapted to oscillate with respect of to said frame and in contrast with an adjustable flexible member, said body and said frame interacting sequentially with said at least two wheels when said skate is tilted.

BRIEF DESCRIPTION OF THE DRAWINGS

Other objects will become apparent during the following description, which must be considered together with the accompanying drawings, which illustrate by way of non-limitative example a particular embodiment and wherein.

DESCRIPTION OF THE PREFERRED EMBODIMENTS OF THE INVENTION

Figure 1:
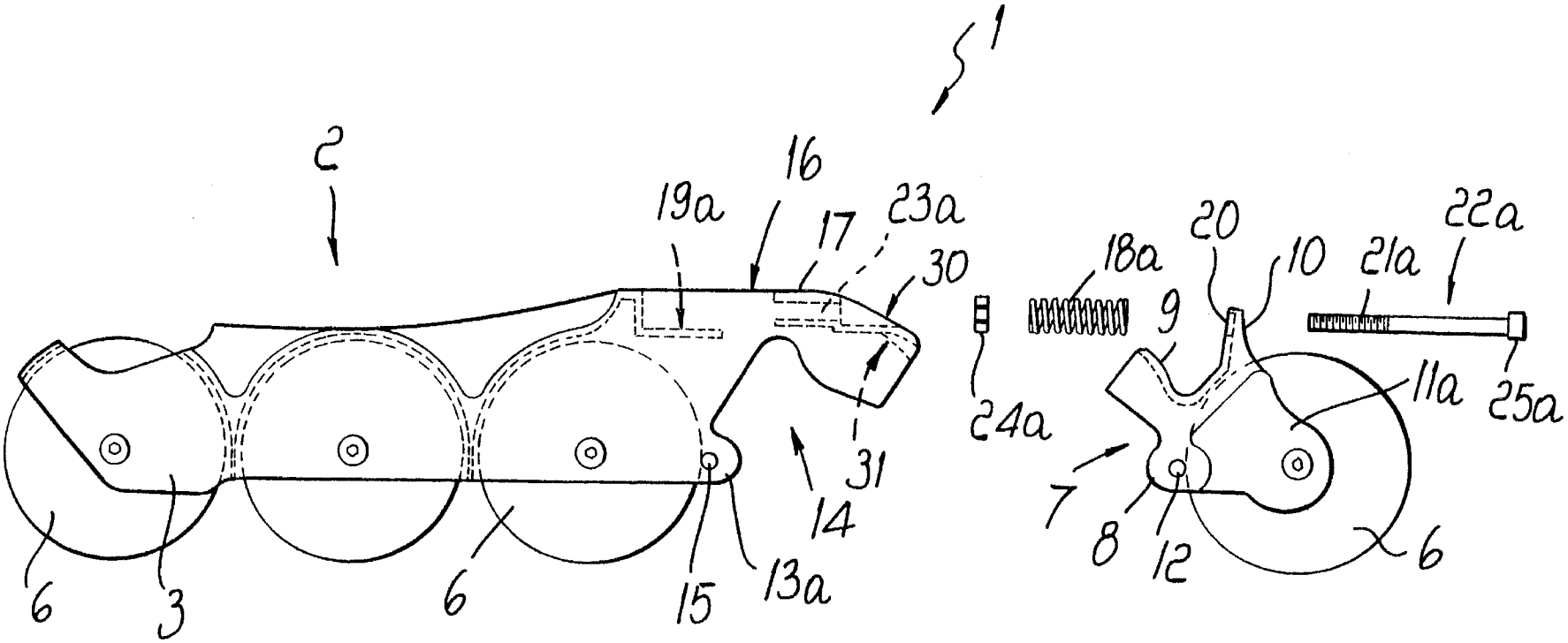
FIG. 1 is a partially sectional side exploded view of the braking device, according to the invention.

With reference to the above figures, and bearing in mind that they exemplify a particular embodiment and are in variable scale, and that individual reference numerals designate identical or equivalent parts, the reference numeral 1 designates the braking device, particularly for in-line skates having a U-shaped frame 2 with first wings 3 and 4 directed towards the ground 5, and a plurality of in-line wheels 6 pivoted to the wings.

The braking device is constituted by a body 7 which is essentially Y-shaped in longitudinal cross-section so as to form a stem 8 which is connected to a second wing 9 and to a third wing 10.

The second wing 9, and partially the third wing 10, are curved and are shaped approximately complementarily with respect to the rolling surface of the wheels 6, both in transverse cross-section and in longitudinal cross-section.

Two first tabs 11*a* and 11*b* are shaped essentially like a triangle with a rounded tip, and connect the stem 8 and the third wing 10. Tabs 11*a* and 11*b* are transversely perforated at one end, and are shaped so as to accommodate a pivot for a single wheel 6, between the tabs, so that the wheel can rotate freely.

One region of the third wing 10 thus faces at least the rolling surface of the wheel that is associated with the body 7.

At least one first hole 12 is formed transversely at the tips of the stem 8 and allows to associate the body 7, so that it can oscillate, at two second tabs 13*a* and 13*b* that protrude at the first wings 3 and 4 of the frame 2, preferably at the rear region thereof.

As an alternative, the second two tabs can protrude at the front region of the frame.

At the above mentioned rear region, the frame also has a recess 14 that allows the body 7 to arrange itself inside the frame 2. Body 7 is connected to the frame by an adapted pivot engaging second holes 15 which are formed at the second two tabs 13*a* and 13*b*.

The body 7 can thus be interposed between two adjacent wheels 6 and is associated with the frame 2 so that it can oscillate. One of the wheels 6 is freely pivoted to the body 7.

The tip of the third wing 10 of the body 7 protrudes upward towards the frame and can be placed at a suitable opening 16, formed transversely to the frame 2, at the base 17 that connects the first wings 3 and 4 in the region above the recess 14.

The tip of the third wing 10 thus interacts in contrast with two flexible members, such as two springs 18*a* and 18*b*, which are arranged at adapted first parallel seats 19*a* and 19*b*. Seats 19*a*, 19*b*, are formed longitudinally at the base 17 of the frame 2.

The third wing 10 also has, at its tip, two third holes or second seats 20 for the stems 21*a* and 21*b* of two screws 22*a* and 22*b* which in turn pass through two fourth holes 23*a* and 23*b*. Fourth holes 23*a*, 23*b* are formed on the base 17 of the frame 2, in a region that is adjacent to the opening 16, and have the same axis as the first seats 19*a* and 19*b*.

The stems 21*a* and 21*b* are thus arranged axially with respect to the springs 18*a* and 18*b*, and their tip can be secured at two bolts 24*a* and 24*b* which are arranged within the first seats 19*a* and 19*b*, without being able to rotate.

The heads 25*a* and 25*b* of the screws 22*a* and 22*b* can be accessed externally and to the rear of the base 17, whereas the springs 18*a* and 18*b* are interposed between the bolts 24*a* and 24*b* and the tip of the third wing 10.

At the base 17, in a region that is adjacent to the fourth holes 23*a* and 23*b*, the frame 2 has a tang 30 that lies above the wheel 6 that is pivoted to the body 7. This tang 30 has a surface 31 shaped complementarily to the facing rolling surface of the wheel 6.

The operation of the braking device is as follows: once the bolts 24*a* and 24*b* and the springs 18*a* and 18*b* have been placed at the first seats 19*a* and 19*b*, and once the body 7 has been inserted in the first wings 3 and 4 of the frame 2, it is possible to rotatably associate the body 7 to the frame, preventing the second wing 9 and the surface 31 of the tang 30 from interacting respectively with the facing wheels 6, because it is possible to pre-load the springs 18*a* and 18*b*, to the required amount by virtue of the screws 22*a* and 22*b*.

Figure 2:
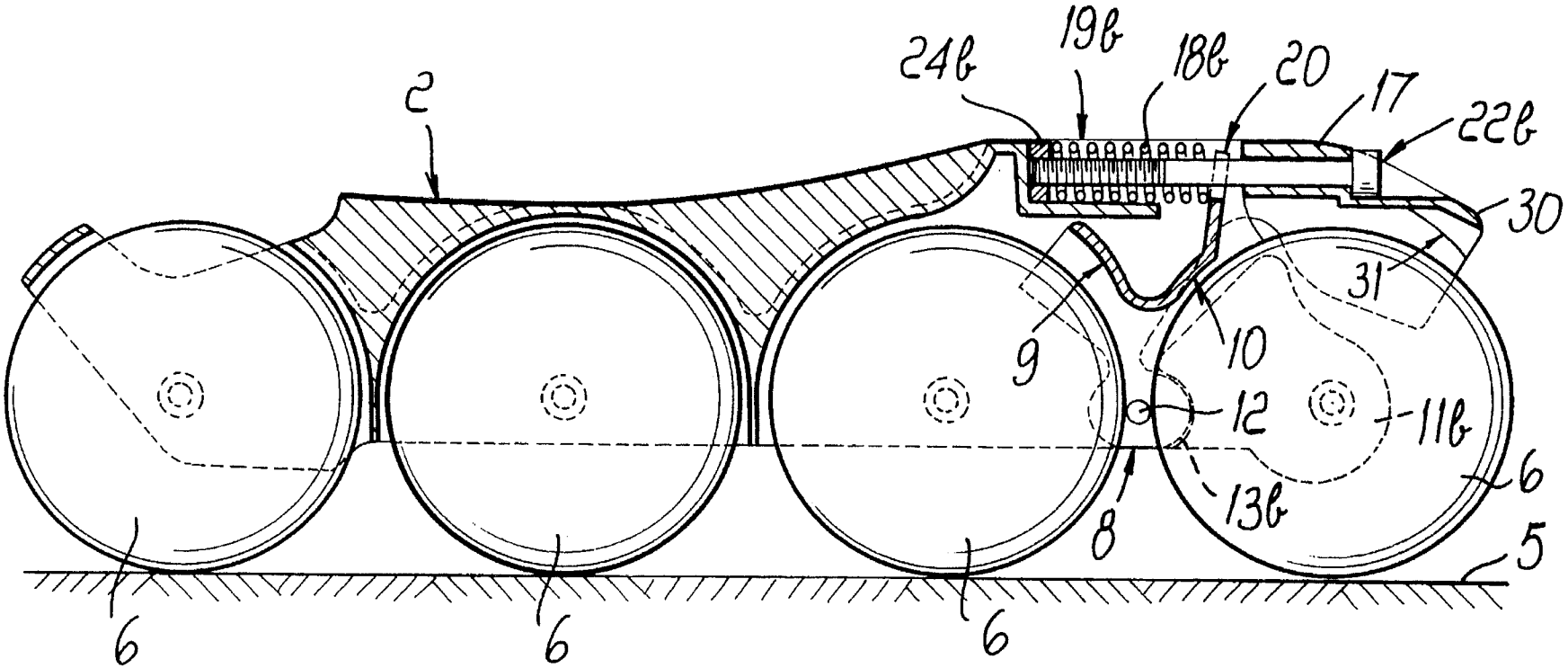
FIG. 2 is a side sectional view of the skate, taken along a median longitudinal plane of the frame, in the rolling position.

FIG. 2 shows the rolling position, wherein the wheels 6 that are adjacent to the body 7 can rotate about their own axes without interfering with the second wing 9 and with the surface 31 of the tang 30.

Figure 3:
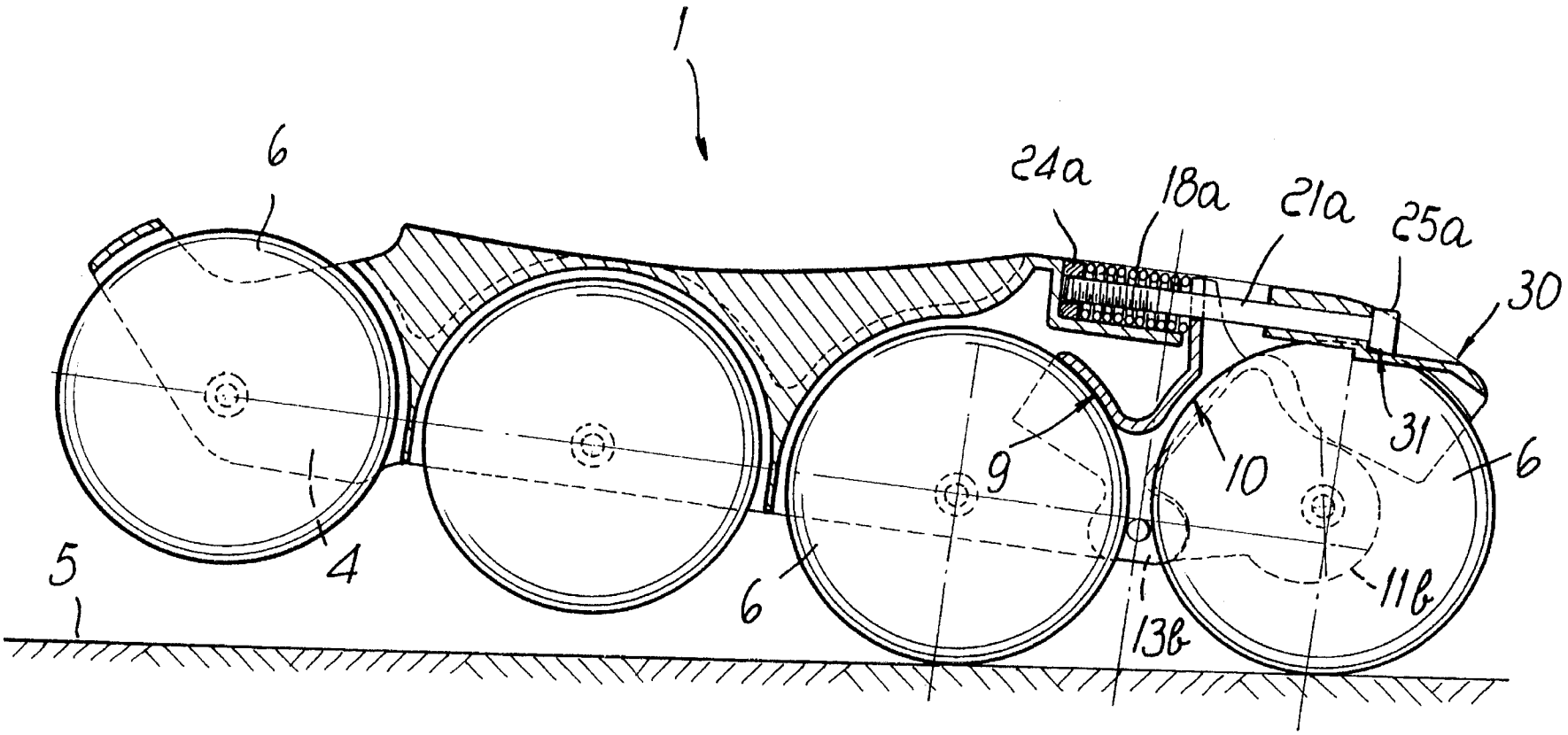
FIG. 3 is a view of the skate similar to the preceding one, in the braking position.
Figure 4:
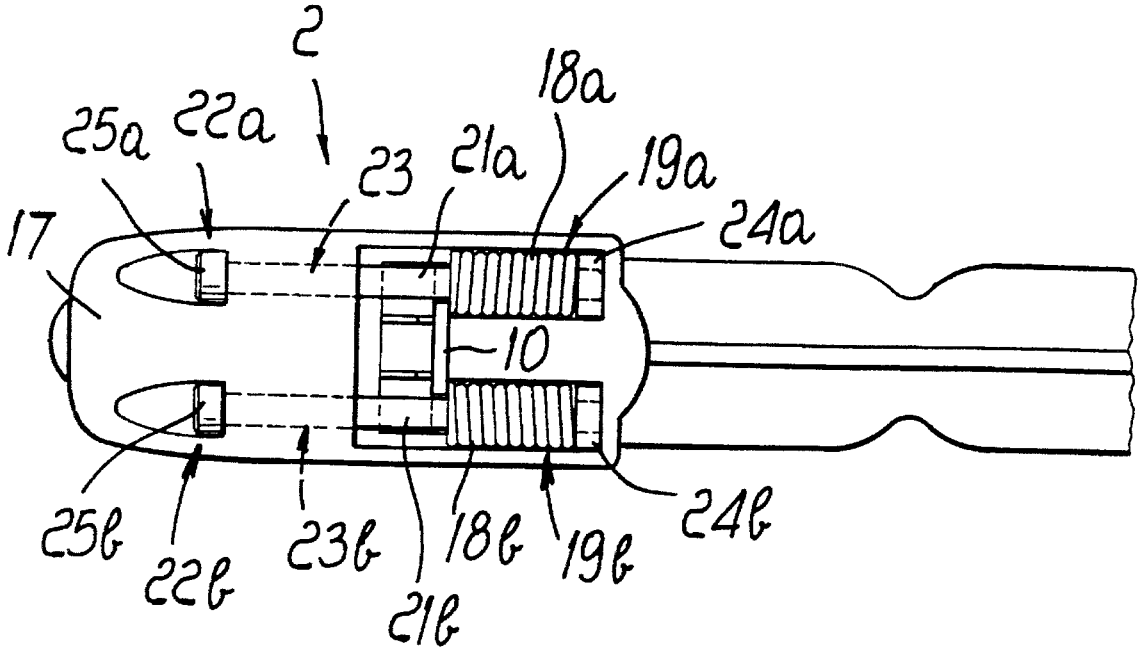
FIG. 4 is a top partial view of the rear part of the skate in the braking position.
Figure 5:
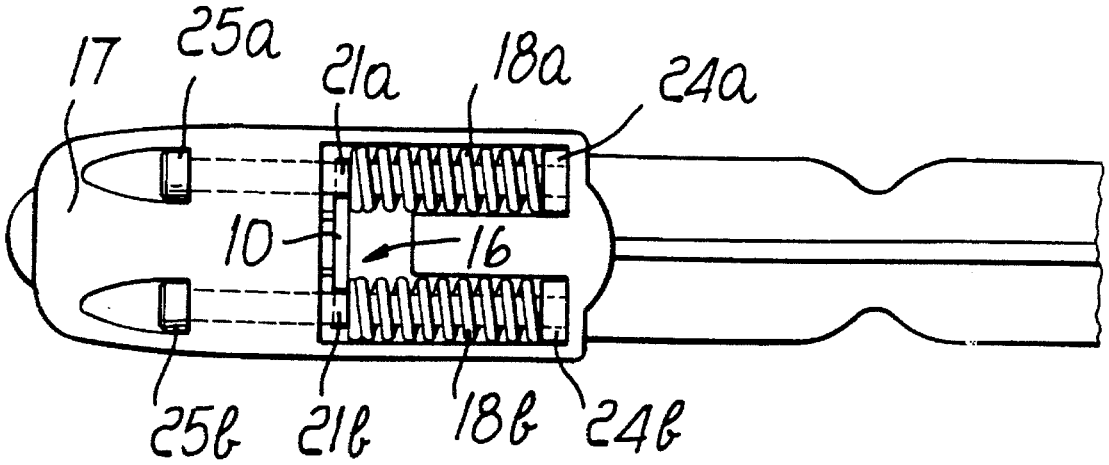
FIG. 5 is a view similar to the preceding one, in the rolling position.

If the user wishes to stop or slow down the skate it is sufficient to tilt the skate backwards so as to compress the springs 18*a* and 18*b*, as shown in FIG. 3, making the second wing 9 rest on the surface of the facing wheel 6 and, at the same time, making the surface 31, of the tang 30, interact with the wheel 6 that is pivoted to the body 7.

In this braking position there are therefore two wheels in contact with the ground, and this also improves the stability that can be achieved by the user.

It is thus evident that the braking device has achieved the intended aim and all the stated objects, allowing the athlete to stop the skate or reduce its speed gradually, by making the second wing 9 interact gradually with a wheel 6 and by making the surface 31 of the tang 30 interact with another wheel. The braking device also allows the user to perform the maneuver in safety, since any imbalance caused by the interaction of the second wing 9 and of the surface 31 with the wheels, improves ground contact, which is provided by two wheels.

The gradual nature of the braking action can also be provided by diversifying the materials used for the second wing 9 and the surface 31 of the tang 30.

The possibility to adjust the compression of the flexible parts also allows to achieve better control over the braking action, customizing it according to the weight of the user, to the type of track being used, and to the particular sport being practiced, such as slalom or speed skating.

If the user does not want to take advantage of the braking action, springs 18*a* and 18*b* can be compressed so as to avoid rotation of the body 7, following a rotation applied to the skate. In this manner, none of the wheels interacts with the second wing 9 or with the surface 31 of the tang 30.

The materials and the dimensions of the individual components of the device may of course vary according to the requirements.

The skate according to the invention is susceptible to numerous modifications and variations, within the scope of the inventive concept. For example, the flexible parts may be constituted by one or more plastic pads or blocks and their compression may be adjustable by using adapted rigid blocks or blocks with different deformations.

I claim:

1. An in-line skate comprising:

a frame;

at least two in-line wheels associated with said frame;

a body pivotably mounted to said frame in a region between the two wheels, one of said wheels being rotatably mounted to said body, another of said wheels being rotatably mounted directly to said frame;

biasing means mounted to said frame for resiliently biasing said body towards a cruising configuration relative to said frame; and braking means including at least two braking surfaces each disposed on one of said frame and said body for frictionally interacting simultaneously with both of said wheels in a tilted braking configuration of said body relative to said frame.

2. The skate defined in claim 1 wherein one of said braking surfaces is provided on said body and another of said braking surfaces is provided on said frame.

3. The skate defined in claim 2 wherein said frame includes a tang, said another of said braking surfaces being provided on said tang, said another of said braking surfaces being shaped complementarily to a rolling surface of said one of said wheels.

4. The skate defined in claim 3 wherein said body is substantially Y-shaped in longitudinal cross-section, said body having a stem pivotably mounted to said frame at a point between said wheels, said body further having a curved first wing and a curved second wing connected to said stem and shaped to conform substantially to rolling surfaces of respective ones of said wheels both in transverse cross-section and in longitudinal cross-section, said one of said braking surfaces being provided on said first wing.

5. The skate defined in claim 1 wherein said body is substantially Y-shaped in longitudinal cross-section, said body having a stem pivotably mounted to said frame at a point between said wheels, said body further having a curved first wing and a curved second wing connected to said stem and shaped to conform substantially to rolling surfaces of respective ones of said wheels both in transverse cross-section and in longitudinal cross-section.

6. The skate defined in claim 5 wherein said body is additionally provided with a pair of substantially parallel tabs extending from said stem and said second wing, said one of said wheels being mounted to said body via said tabs.

7. The skate defined in claim 6 wherein said frame is provided with a pair of substantially parallel additional tabs, said stem being pivotably connected to said frame via said additional tabs.

8. The skate defined in claim 7 wherein said frame includes a base and a pair of third wings connected to said base, said body being at least partially disposed in a recess between said third wings.

9. The skate defined in claim 8 wherein said base is provided with an opening formed transversely to said frame, said second wing being provided with a protruding tip extending into said opening.

10. The skate defined in claim 9 wherein said biasing means includes a pair of flexible members disposed in respective parallel seats formed longitudinally in said base, said protruding tip being in operative engagement with said flexible members for biasing said body towards said cruising configuration relative to said frame.

11. The skate defined in claim 10, further comprising adjustment means on said frame and operatively coupled to said biasing means for adjusting an amount of angular force or torque applied by said biasing means to said body, thereby enabling one to customize braking action of the skate.

12. The skate defined in claim 11 wherein said adjustment means includes a pair of screws having stems traversing respective holes provided in said protruding tip and also traversing respective apertures in said base, said stems extending into respective ones of said seats.

13. The skate defined in claim 12 wherein said flexible members take the form of helical compression springs, said screws extending longitudinally through respective ones of said springs, said adjustment means further including a pair of nuts disposed in said seats, said screws being secured to respective ones of said nuts.

14. The skate defined in claim 13 wherein said springs are interposed between said nuts and said protruding tips, said screws having heads accessible from outside said frame for facilitating adjustment of the angular force or torque applied by said biasing means to said body.

15. An in-line skate comprising:

a frame;

at least two in-line wheels associated with said frame;

a body pivotably mounted to said frame in a region between the two wheels, one of said wheels being rotatably mounted to said body, another of said wheels being rotatably mounted directly to said frame;

biasing means mounted to said frame for resiliently biasing said body towards a cruising configuration relative to said frame;

braking means disposed on at least one of said frame and said body for frictionally interacting with at least one of said wheels in a tilted braking configuration of said body relative to said frame, said braking means including at least two braking surfaces, one of said braking surfaces being provided on said body and another of said braking surfaces being provided on said frame; and adjustment means on said frame and operatively coupled to said biasing means for adjusting an amount of angular force or torque applied by said biasing means to said body, thereby enabling one to customize braking action of the skate.

16. The skate defined in claim 15 wherein said frame includes a tang, said another of said braking surfaces being provided on said tang, said another of said braking surfaces being shaped complementarily to a rolling surface of said one of said wheels.

17. The skate defined in claim 15 wherein said frame includes a base and a pair of wings connected to said base, said body being at least partially disposed in a recess between said wings, said base being provided with an opening formed transversely to said frame, said body being provided with a protruding tip extending into said opening, said biasing means including a pair of flexible members disposed in respective parallel seats formed longitudinally in said base, said protruding tip being in operative engagement with said flexible members for biasing said body towards said cruising configuration relative to said frame, said adjustment means including a pair of screws having stems traversing respective holes provided in said protruding tip and also traversing respective apertures in said base, said stems extending into respective ones of said seats.

18. The skate defined in claim 17 wherein said flexible members take the form of helical compression springs, said screws extending longitudinally through respective ones of said springs, said adjustment means further including a pair of nuts disposed in said seats, said screws being secured to respective ones of said nuts, said springs being interposed between said nuts and said protruding tips, said screws having heads accessible from outside said frame for facilitating adjustment of the angular force or torque applied by said biasing means to said body.

19. An in-line skate comprising:

a frame;

at least two in-line wheels associated with said frame;

a body pivotably mounted to said frame in a region between the two wheels, one of said wheels being rotatably mounted to said body, another of said wheels being rotatably mounted directly to said frame, said body being substantially Y-shaped in longitudinal cross-section, said body having a stem pivotably mounted to said frame at a point between said wheels, said body further having a curved first wing and a curved second wing connected to said stem and shaped to conform substantially to rolling surfaces of respective ones of said wheels both in transverse cross-section and in longitudinal cross-section, said body being additionally provided with a pair of substantially parallel tabs extending from said stem and said second wing, said one of said wheels being mounted to said body via said tabs, said frame is provided with a pair of substantially parallel additional tabs, said stem being pivotably connected to said frame via said additional tabs;

biasing means mounted to said frame for resiliently biasing said body towards a cruising configuration relative to said frame;

braking means disposed on at least one of said frame and said body for frictionally interacting with at least one of said wheels in a tilted braking configuration of said body relative to said frame; and adjustment means on said frame and operatively coupled to said biasing means for adjusting an amount of angular force or torque applied by said biasing means to said body, thereby enabling one to customize braking action of the skate.

* * * * *